US006470536B1

(12) United States Patent
Kettlestrings et al.

(10) Patent No.: US 6,470,536 B1
(45) Date of Patent: Oct. 29, 2002

(54) CLIP BOARD WITH IMPROVED RETENTION MEANS

(76) Inventors: Jason Todd Kettlestrings, 900 Bainbridge Dr., Naperville, IL (US) 60563; Jack Kettlestrings, 900 Bainbridge Dr., Naperville, IL (US) 60563

( * ) Notice: Subject to any disclaimer, the term of this patent is extended or adjusted under 35 U.S.C. 154(b) by 0 days.

(21) Appl. No.: 09/877,996

(22) Filed: Jun. 11, 2001

(51) Int. Cl.[7] ..... B42F 1/02
(52) U.S. Cl. ..... 24/67.7; 24/67 R
(58) Field of Search ..... 24/67 R, 67.3, 24/67.5, 67.9, 67.11, 67.7; 281/30, 45–49

(56) References Cited

U.S. PATENT DOCUMENTS 2,202,267 A * 5/1940 Posnack
2,783,062 A 2/1957 Helberg
2,996,775 A * 8/1961 Vernon
3,105,279 A * 10/1963 Westhoff
3,127,649 A * 4/1964 Linsenmayer
3,246,914 A * 4/1966 Goodwin
3,828,402 A 8/1974 Gorman
4,739,541 A 4/1988 Pitts
5,058,242 A * 10/1991 Liu et al.
5,226,215 A 7/1993 Evenson
5,236,760 A * 8/1993 Jinn
5,725,250 A * 3/1998 Balderrama
6,352,229 B1 * 3/2002 Adams

* cited by examiner

*Primary Examiner*—James R. Brittain
(74) *Attorney, Agent, or Firm*—James Van Santen

(57) ABSTRACT

The clamping clip construction of a clip board is improved by changing the clamping member to provide an offset flange formed with a shelf-like tray at the end, thereby to shorten the clip and enlarging the available space on the board, and shortening the distance to the pivot axis to increase the clamping force, and to provide an enlarged paper engaging surface to safeguard the papers on the board. Retention means are also provided which, together with the tray, form a snap-in detent so that elongated objects such as pens and pencils may be stored and retrieved directly on the clip construction of the clip board.

8 Claims, 2 Drawing Sheets

CLIP BOARD WITH IMPROVED RETENTION MEANS

BACKGROUND OF THE INVENTION

1. Field of the Invention

This invention relates generally to clip boards and more particularly to an improved clip, or clamping, construction for use at one end of a stiff, rectangular board so that elongated objects such as pencils, pens, marking instruments may be employed by the user with great facility when the clip board is being used as a portable writing surface.

2. The Prior Art

Clip boards are generally so well known in the art that they are defined in the dictionary as comprising a stiff rectangular board having at one end a clip for holding paper, a writing pad, or the like, and serving as a portable writing surface.

The usual form of commercially available clip board satisfying that definition provides a wooden or plastic or composition board on which is mounted a metal clip construction featuring the employment of a base member secured to the board, a pivot axis rod, a spring unit and a pivotally movable clamping member.

The clamping member usually takes the form of a flat metallic plate having intermediate offset arms connected to the base member by a spring biased hinge. The pivot axis rod is biased by the spring unit so that the upper part of the plate on one side of the pivot axis functions as an actuating handle. The lower end of the plate on the other side of the pivot axis is spring loaded downwardly against the writing surface of the board. The free end of the plate takes the form of a laterally extending clamping edge which serves to hold paper sheets, or a writing pad, or a collection of loose papers on the board. Thus, the board serves as a portable writing surface for the user who wishes to enter notations on the paper articles clamped by the clip.

Pencil holders have been provided on clip boards of the prior art. For example, U.S. Pat. No. 2,783,062 utilizes a spring pencil holding finger to hold a pencil longitudinally of the clip board. U.S. Pat. No. 3,105,279 has a pencil holder which extends through a slot and overlies the biasing spring on one side of the slot while providing a portion overlying the clamp plate on the other side of the slot for clamping a pencil. U.S. Pat. No. 3,828,402 provides a plurality of spring fingers on the edge of the clamping plate so that the user may insert the end of a pencil under one or more of the spring fingers. U.S. Pat. No. 4,739,541 utilizes an elastic band which may be stretched to accept a pencil or other object under the band. U.S. Pat. No. 5,058,242 provides a separate pen holder which is detachably attached as an accessory to the clip board for holding a pen. U.S. Pat. No. 5,226,215 has a clipboard with molded indentations in the shape of a writing utensil in which the utensil may be locked in place with compressive force. U.S. Pat. No. 5,725,250 uses an apertured edge in the clamping member to capture a writing instrument disposed longitudinally relative to the board to assist in retention of papers on the board.

BRIEF SUMMARY OF THE INVENTION

Since clip boards are highly portable, they are particularly suited for employment by persons recording data in the field, i.e., in a form of usage requiring intermittent use at changing locations. Hence, a special problem which oftentimes plagues the user of a clip board is that the writing or marking instrument utilized to mark the materials on the board will be misplaced, or set down. Consequently, there is a need for an improved form of convenient retention means suitable for receiving and retaining elongated objects, such as pencils and pens. Such retention means should be integrated with the clip board in an unobtrusive manner without impairing the normal functioning of the clip board and without necessitating the use of dangling strings, elastic bands or separate detachable holding accessories, or without the necessity of altering the basic characteristics of the board itself.

It is contemplated by the present invention to form a clamping plate for a clip board in such a manner that there is defined a laterally extending shelf-like tray at the terminal edge closely adjacent the writing surface of the board. Such tray may be rounded in the shape of a curve to form a cradle, if desired. In any event, the lower surface of the tray forms an enlarged surface contact with the paper articles inserted beneath it. By virtue of such provision, the paper articles are clamped and supported at a location closer to the pivot axis of the clip, increasing the force applied to the board or its contents.

The profile of the tray also provides an area contact with the paper articles, rather than a line contact as occurs in prior art devices, and is thus less damaging to delicate or important documents being processed by the user. Further, the usable area of the board is increased in the clamping area.

The upper surface of the shelf-like tray forms a receptacle receiving and seating elongated objects. It is further contemplated that a supplemental locking means may be provided which forms together with the tray a snap-in detent or retention lock. Thus, a pencil, or a pen, or a marking device, may be conveniently inserted into the tray when not in actual use for quick and convenient retrieval on demand by the user of the clip board.

Various species embodying the generic concept of this invention are disclosed so that artisans may be given their choice of options in constructing a clip board in accordance with this invention.

DETAILED DESCRIPTION OF THE INVENTION

Figure 1:
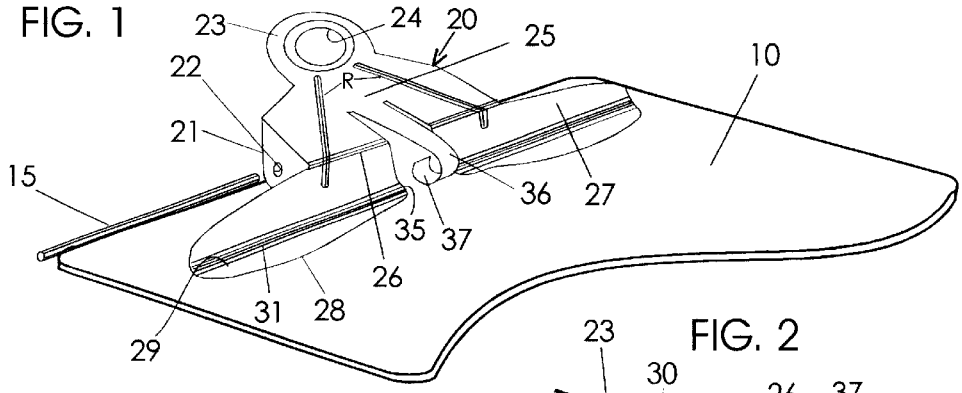
FIG. 1 is a broken perspective view, and partially exploded, showing a clip board assembly provided in accordance with one form of the present invention.

The present invention is particulary directed at improvements to the upper clamping portion of a clip board utilized by many users as a portable writing surface. In the environment of a clip board, there is customarily provided a stiff rectangular board having at one end a clip construction with a spring loaded hinge for holding paper, or a writing pad, or the like.

Such a board is shown at 10 and may be made of a flat wooden board, or of plastic or pressed paper board. The clip construction usually includes a flat metallic stamping forming a base 11 connected in firm assembly with the board 10 by means of fasteners such as rivets 12, or other suitable fastening means. The base 11 has a pair of laterally spaced apart upwardly projecting arms 13 apertured as at 14, (FIG. 2) thereby to mount a pivot pin 15 which may take the form of a rigid metal rod extending between the arms 13 to establish a pivot axis 16.

In accordance with this invention, there is provided a clamping member 20. The clamping member 20 is conveniently formed as a metal stamping having two arms 21 offset from an intermediate portion of the article and which arms 21 are disposed to be complemental to the arms 13 on the base 11. The arms 21 are each apertured as at 22 so that the clamping member 20 is pivotally mounted on the pivot pin 15 for movement towards and away from the surface of the board 10.

A coil spring means 30 is provided. In conventional practice, the spring means 30 will have one or more coils of wound spring wire carried on the pivot pin 15 and operatively anchored against the base 11 and engaged with the clamping member 20 so as to continuously torque load the clamping member 20 relative to the pivot axis 16. Thus, the clamping member 20 will be angularly moved so that the portion of the clamping member 20 on the lower side of the pivot axis 16 will engage the board 10 in such a manner that it will be spring loaded to grip and retain papers, or note pads, or working documents firmly on the board 10.

In the usual prior art form of clip board, the clamping member will have an upper portion forming an actuating arm 23 disposed on the upper side of the pivot axis 16. By pressing down on the arm 23 to overcome the bias of the spring means 30, the clamping arm 20 may be pivotally rotated to lift the lower end of the clamping member 20, thereby releasing the objects clamped thereby.

Since clip boards are particularly suited for providing a portable writing surface, they are most frequently employed in working environments where the user depends on the portability convenience. However, the writing instruments used to mark or inscribe the papers on the clip board are loose and are frequently misplaced or set down, thereby frustrating the efficient use of the clip board.

By this invention, we have provided advantageous changes to the clamping member 20 and improved writing instrument retention means. The clamping member 20 has the usual actuating arm 23 shown in FIG. 1 as constituting a somewhat arcuate section with a center opening 24 extending there through. The opening 24 may be used for storing and suspending the clip board from a hook, if desired.

Extending away from the arcuate portion and disposed inwardly of the arms 21 is a flat body portion 25 which in customary prior art devices terminates in an offset rim providing an elongated edge for engaging the board 10, or paper objects inserted beneath the edge in line contact therewith. The usual embossed strengthening ribs are formed in the body portion 25 as shown in FIG. 1 at "R."

Figure 2:
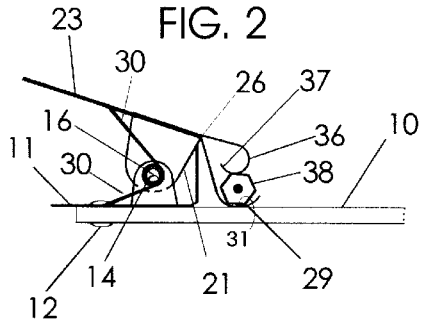
FIG. 2 is an end elevational view of the form of the invention of FIG. 1, and showing in fragmentary cross-section a complete clip board assembly in accordance with this invention, and with an elongated hexagonal object retained in the clip, or clamping structure.
Figure 3:
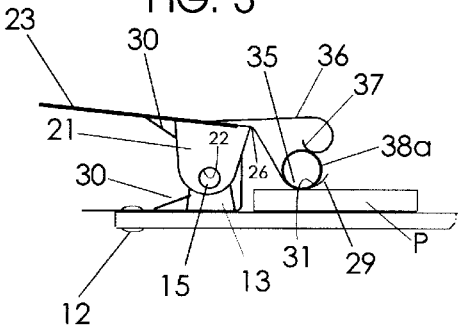
FIG. 3 is a view similar to FIG. 2 but showing a working article on the board clamped by the clip and showing an elongated cylindrical object retained on the clip.

According to the present invention, the flat body portion 25 is offset at a bend line 26 so that a widened flange 27 extends through an offset plane in the direction of the board 10. At the end of the flange there is formed by bending and shaping a shelflike tray 28 which extends laterally from side to side of the flange 27. Referring to the profile shape of the tray 28 as depicted in FIGS. 2 and 3, it will be noted that the tray 28 may be formed in a curved configuration to form what could be analogized to a cradle which functions as a receptacle. The bottom, or lower surface of the tray 28 forms an engagement surface 29 for engaging paper objects on the board 10. By virtue of such profile, the tray 28 and its engagement surface 29 supports the papers, or contents, of the board 10 closer to the pivot axis 16, thereby increasing the force applied to the board 10 and its contents. Moreover, the curved engagement surface 29 avoids a sharp damaging line contact with delicate, or otherwise important, papers and is shaped so as to provide what is essentially area contact with the board 10 and its contents. The useable area on the board 10 is also increased.

It will also be apparent that the upper surface 31 of the tray 28 forms a receptacle 35 for receiving elongated objects such as pens and pencils, or the like. In order to keep such elongated objects integrated with the receptacle 35 and with the clip board 10, we have additionally provided improved retention means on the clamping member 20 itself.

In the form of the invention disclosed in FIGS. 1–3, it will be noted that the clamping member 20 is provided with a flat body portion 25 having a struck-out band or tongue 36 which projects forwardly the full extent of the clamping member 20. The band or tongue 36 is preferably reversely curved at its endmost extremity to form a finger 37 overlying the receptacle 35. Together with the tray 28, the band or tongue 36, and its finger 37, form a snap-in detent which operates as a catch, or lock, to keep the elongated object seated and retained in the receptacle 35 until the user desires to retrieve it, whereupon, it may be quickly, easily and conveniently be removed from the receptacle 35 for further use.

The retention means of FIGS. 1–3 accommodates objects of different size quite readily. Thus, as shown in FIG. 2, an elongated object 38 having a hexagonal crosssection and of relatively smaller size is readily retained in the receptacle 35. In FIG. 3, there is shown an elongated object 38*a* of cylindrical cross-section. It, too, is readily accommodated with a snap-in fit, even when the clamping member 20 is simultaneously grasping and effectively clamping a pad of paper P. (FIG. 2)

Figure 4:
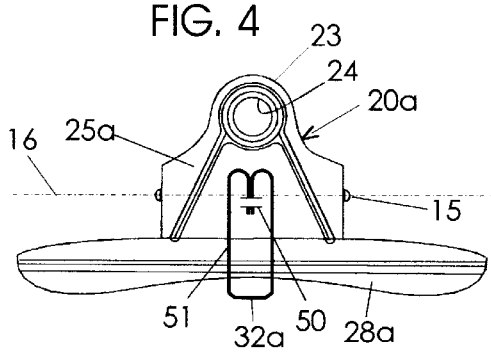
FIG. 4 is a fragmentary plan elevational view of another form of the invention utilizing a supplemental spring loading retainer.
Figure 5:
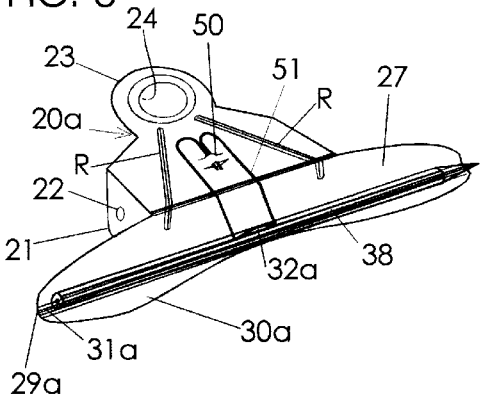
FIG. 5 is a perspective view of the clip board of FIG. 4 showing a writing instrument locked in retention on the clip board.
Figure 6:
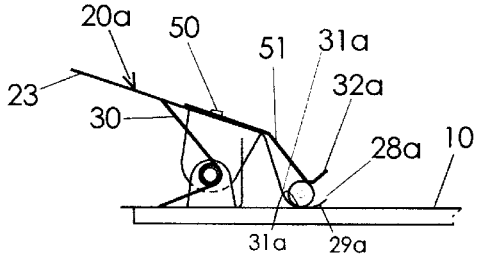
FIG. 6 is an end elevational view of a clip board assembly utilizing the form of the invention referred to in FIGS. 4 and 5.
Figure 7:
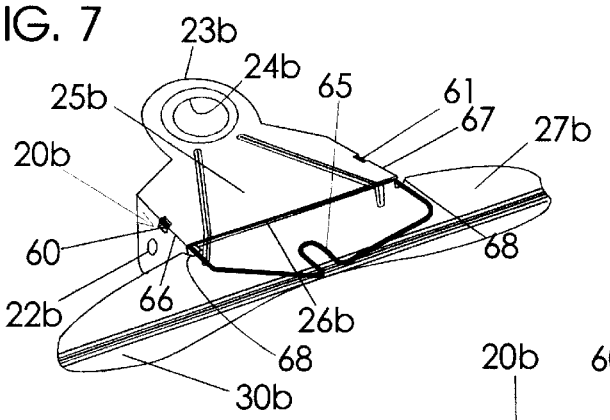
FIG. 7 is a perspective view similar to FIG. 5 but showing another form of the invention wherein a spring construction of a different configuration effects a connection of inserted articles with the clip board.

In FIGS. 4, 5 and 6, a clamping member 20*a* is modified to provide a lanced port 50 formed in the flat body portion 25*a*. The port 50 receives and seats in locked relationship the opposite ends of an elongated spring wire 51. The intermediate portions of the spring wire 51 are formed in a U-shape so that a bight portion shaped to provide an engagement finger 32*a* which cooperates with the tray 28*a* to retain elongated objects in the receptacle 35*a*. Parts similar to corresponding parts in the form of FIGS. 1–3 are designated with the same numeral plus the suffix "a."

In the form of the invention illustrated in FIGS. 7–11 inclusive, instead of a single lanced port 50 to accommodate both ends of the spring wire 50, there are spaced apart lanced ports 60 and 61 through which a corresponding end 62 and 63 of a wire 65 passes. Note that the lanced ports 60 and 61 are conveniently struck, or lanced, simply by inwardly offsetting an intermediate part of the bending creases 66 and 67 on opposite sides of the clamping member 20*b*, i.e., at the upper end of each of the arms 20*b*. Sufficient relief 68 is also provided in the bend line 26*b* between the widened body 25*b* and the flange 27*b* at each respective arm 20*b* so that a leg 65*a* at one end of the wire 65 and a leg 65*b* at the other end of the wire 65 extends forwardly in the creases 66 and 67 respectively and project forwardly of the body portion 25*b* superjacent the receptacle 35*b*.

The wire 65 has two arms 65*c* and 65*d*. Each arm 65*c* and 65*d* is offset angularly to extend laterally inwardly and forwardly as shown in FIG. 5. At the centermost inner portion the arms 65*c* and 65*d* join one another at a rearwardly extending center U-shaped finger 65*e*. The finger 65*e* has parallel spaced apart legs 65*f* and 65*g* joined by a center bight portion 65*h*.

Figure 8:
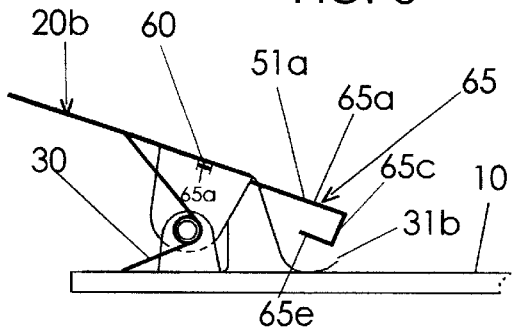
FIG. 8 is an end elevation of the clamping member of FIG. 7.
Figure 9:
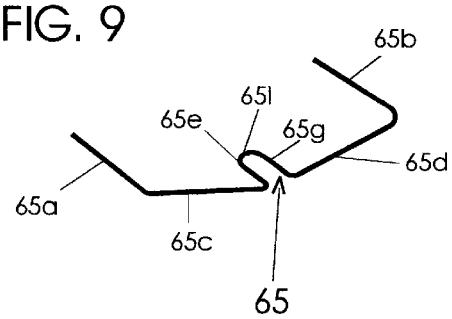
FIG. 9 is a perspective view of the spring utilized in the form of the invention shown in FIGS. 7 and 8.
Figure 10:
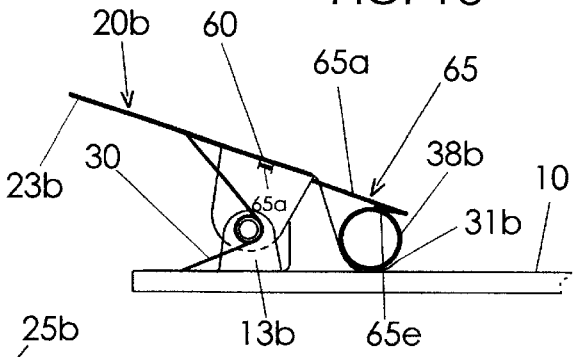
FIG. 10 is a side elevational view similar to FIG. 8 but showing a cylindrical object retained on the clip board.
Figure 11:
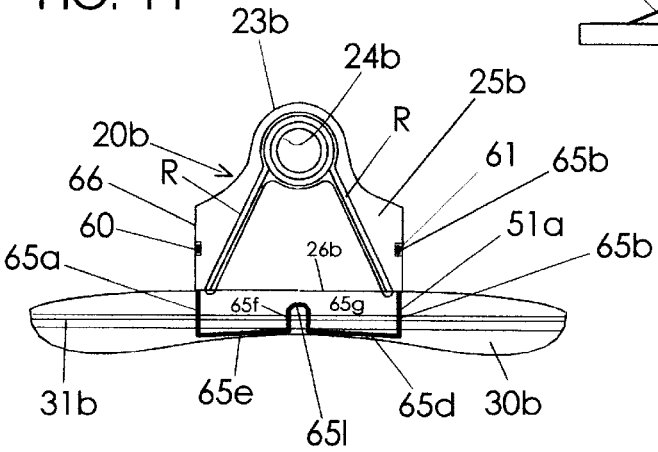
FIG. 11 is a fragmentary plan elevational view of the clip board construction of FIGS. 7–10 to show additional details of the invention.

In bending and shaping the wire 65, the legs 65*f* and 65*g* of the finger 65*e* may be offset out of a common plane as depicted in FIG. 8 so that when an object such as a writing instrument is inserted between the finger 65*e* and the receptacle 35*b*, the finger 65*e* will be displaced upwardly, thereby exerting a locking bias to firmly retain the writing instrument in the receptacle 35*b*.

In all forms of the invention, the improved clamping members afford the advantages of improved force distribution, tray profile and increased board space, and the addition of retention means affords the convenience of keeping writing instruments in an accessible quickly retrievable location.

Although minor modifications might be suggested by those artisans skilled in the art, it should be understood that we wish to embody within the scope of the patent warranted hereon all such modifications as reasonably and properly come within our contribution to the art.

We claim as our invention:

1. In a clip board of the type having a flat board carrying a pivotal clamp on a spring loaded hinge at one end thereof, the improvement of:

a clamping member having a laterally extending edge curved and shaped to form an elongated shelf-like tray with a lower convex surface for area contact engagement with paper articles on the clip board under spring loading and an upper concave surface forming a receptacle for receiving, seating and retaining elongated objects inserted therein, said clamping member and said shelf-like tray being laterally coextensive and said clamping member having retention means forming together with said tray a lock to selectively keep said elongated objects integrated in said receptacle.

2. In a clip board of the type having a flat board carrying a pivotal clamp on a spring loaded hinge at one end thereof, the improvement of:

a clamping member having a laterally extending edge curved and shaped to form an elongated shelf-like tray with a lower convex surface for area contact engagement with paper articles on the clip board under spring loading and an upper concave surface forming a receptacle for receiving, seating and retaining elongated objects inserted therein, said clamping member having spring means overlying said tray and forming together therewith a snap-in detent lock for retaining an elongated object in said receptacle.

3. In a clip board as defined in claim 2, said spring means comprises a tongue integral with but struck out from said clamping member and offset from the plane of said clamping member to overlie the receptacle, said tongue being reversely curved to form a finger which together with said receptacle forms a detent for receiving and retaining an elongated object such as a writing instrument.

4. In a clip board as defined in claim 2, wherein said spring means comprises a separate spring member fastened to said clamping member and having a portion projecting to overlie said receptacle, said separate spring member having a centrally disposed finger portion, which together with said receptacle forms a detent for receiving and retaining an elongated object such as a writing instrument.

5. In a clip board as defined in claim 4, wherein said clamping member has lanced out opening means and said spring means comprises a resilient spring wire having its opposite ends retained in said lanced out opening means, said wire being bent and shaped to form a leg overlying said receptacle and forming together therewith said detent.

6. In a clip board, a clamping member pivotally carried on one end of the clip board, said clamping member comprising a flat metal stamped plate having a planar body formed with an eye opening at one end, a spring loaded hinge comprising a pivot pin mounting means for pivotally mounting said clamping member on the board and having spring loading means continuously biasing said clamping member against said board, said clamping member having a longitudinally extending portion extending from said eye on one side of the pivot pin to the other side of the pivot pin and terminating in a laterally extending edge adapted to engage sheet form objects such as paper carried on the board, said edge being shaped and formed to provide a curved shelf-like tray laterally coextensive with said edge, said tray having a convex lower surface for engaging the sheet form objects and a concave upper surface forming a cradle receptacle for receiving and seating an elongated object such as a writing instrument, and retention means on said clamping member forming together with said cradle receptacle a lock to keep said elongated object integrated with said cradle receptacle at the selective option of the user.

7. In a clip board having a spring loaded clamping member intermediately hinged on a pivot axis to provide an upwardly projecting actuating portion on one side of the pivot axis and a downwardly projecting clamping portion on the other side of the pivot axis for engaging the board to clamp and retain sheet form paper objects on the clip board when the board is used as a portable writing surface, the improvement of:

clamping means having a flange formed with an elongated shelf-like tray formed and disposed at its outermost edge, said shelf-like tray having a lower surface shaped to provide area contact engagement with sheet form paper objects on the board, and having an upper surface shaped to form a cradle receptacle for receiving elongated objects such as an elongated writing instrument, said clamping means having retention means forming together with said cradle receptacle a lock to selectively integrate the writing instrument in said cradle receptacle.

8. In a clip board having a spring loaded clamping member intermediately hinged on a pivot axis to provide an upwardly projecting actuating portion on one side of the pivot axis and a downwardly projecting clamping portion on the other side of the pivot axis for engaging the board to clamp and retain sheet form paper objects on the clip board when the board is used as a portable writing surface, the improvement of:

clamping means having a flange formed with an elongated shelf-like tray formed and disposed at its outermost edge, said shelf-like tray having a lower surface shaped to provide area contact engagement with sheet form paper objects on the board, and having an upper surface shaped to form a cradle receptacle for receiving elongated objects such as an elongated writing instrument, said clamping means having retention means forming together with said cradle receptacle a lock to selectively integrate the writing instrument in said cradle receptacle, said clamping means having a body portion and arms at opposite sides each bent to be offset at right angles to said body portion thereby providing the pivot axis for the clamping means, supplemental spring means comprising a spring wire bent to form a first pair of spaced apart parallel arms, said body portion having a lanced port formed at a corner between each arm and said body portion of said clamping means, each of said arms of said spring wire passing through and retained in a corresponding one of said lanced ports and each of said arms of said spring wire projecting forwardly of said flange, said spring wire being formed to have a second pair of arms offset angularly from each corresponding one of said first pair of arms to extend laterally inwardly and forwardly towards one another, each said second pair of arms joining one another in a centrally disposed U-shaped finger offset from the plane of the spring wire and extending rearwardly so that the finger overlies the receptacle, whereby the spring wire and its finger together with the receptacle forms a spring biased detent receiving and retaining elongated objects such as writing instruments therein.

* * * * *